US010667564B2

(12) United States Patent
Maynard

(10) Patent No.: US 10,667,564 B2
(45) Date of Patent: Jun. 2, 2020

(54) MALE UNDERGARMENT

(71) Applicant: Michael Maynard, O'Fallon, MO (US)

(72) Inventor: Michael Maynard, O'Fallon, MO (US)

( * ) Notice: Subject to any disclaimer, the term of this patent is extended or adjusted under 35 U.S.C. 154(b) by 0 days.

(21) Appl. No.: 16/208,946

(22) Filed: Dec. 4, 2018

(65) Prior Publication Data

US 2019/0166921 A1 Jun. 6, 2019

Related U.S. Application Data

(60) Provisional application No. 62/594,236, filed on Dec. 4, 2017.

(51) Int. Cl.
*A41B 9/02* (2006.01)
*A41B 9/00* (2006.01)
*A41D 13/12* (2006.01)

(52) U.S. Cl.
CPC ..... *A41B 9/026* (2013.01); *A41B 9/001* (2013.01); *A41B 9/005* (2013.01); *A41B 9/023* (2013.01); *A41B 2300/30* (2013.01); *A41D 13/1254* (2013.01)

(58) Field of Classification Search
CPC ..... A41B 9/026; A41B 9/001; A41B 9/005; A41B 9/023
USPC ..... 2/405
See application file for complete search history.

(56) References Cited

U.S. PATENT DOCUMENTS

| | | | | |
|---|---|---|---|---|
| 2,139,532 | A * | 12/1938 | Westerman | A41B 9/02 602/67 |
| 6,862,746 | B2 * | 3/2005 | Cym | A41B 9/023 2/403 |
| 7,024,703 | B1 * | 4/2006 | Della Ratta | A41B 9/023 2/400 |
| 7,100,213 | B2 * | 9/2006 | Krautbauer | A41B 9/001 2/400 |
| D762,045 | S * | 7/2016 | Popp | D2/712 |
| 2004/0231034 | A1 * | 11/2004 | Cym | A41B 9/023 2/403 |
| 2014/0289935 | A1 * | 10/2014 | Astin | A41B 9/026 2/403 |
| 2019/0166921 | A1 * | 6/2019 | Maynard | A41B 9/026 |

* cited by examiner

*Primary Examiner* — Gloria M Hale
(74) *Attorney, Agent, or Firm* — Dunlap Bennett & Ludwig PLLC

(57) ABSTRACT

A male undergarment with an expanding iris opening for maintaining the penis of a male wearer in a natural position is provided. The iris opening may be defined by a protruding boundary sleeve extending perpendicular from a crotch portion of the undergarment. The undergarment also provides a veil attached along the crotch portion, affording privacy and comfort by being movable between a concealed condition and a revealed condition.

5 Claims, 3 Drawing Sheets

MALE UNDERGARMENT

CROSS-REFERENCE TO RELATED APPLICATION

This application claims the benefit of priority of U.S. provisional application No. 62/594,236, filed 4 Dec. 2017, the contents of which are herein incorporated by reference.

BACKGROUND OF THE INVENTION

The present invention relates to undergarments and, more particularly, a male undergarment with an expanding iris opening and veil. The expanding iris of the undergarment supports and holds the male wearer's penis in its natural position, while the veil provides privacy in a concealed condition and is movable to a revealed condition.

With traditional men's underwear, the penis is confined, preventing it from resting in its desired position. As a result, men are urged to reposition their penis numerous times daily, which is socially unacceptable, awkward and potentially embarrassing. Thus, while most men's underwear is designed for overall comfort and appearance, they lack the ability to place or hold the penis in its natural position.

As can be seen, there is a need for a male undergarment with an expanding iris opening whereby the penis can be held or placed in its natural position. The present invention includes an undergarment having an expandable iris with veil, wherein the iris is dimensioned and adapted to accommodate a stationary position for the penis aligning with a man's most natural position, which is downward and not confined. The iris opening prevents the penis from shifting from its most desired position as it provides a boundary support for said natural position, so that the wearer no longer needs to grab their penis to become at ease. The present invention also provides a veil for covering the penis of a human wearer supported by the iris opening. As a result, the penis will not move from its natural position, which eliminates the need to reposition the penis as with traditional underwear.

SUMMARY OF THE INVENTION

In one aspect of the present invention, a male undergarment includes the following: a crotch portion dimensioned and adapted to be located adjacent to and cover a crotch region of the human wearer when the undergarment is worn; an expandable iris opening adapted to be located adjacent to and cover a penis of the human wearer; and a boundary sleeve defining a periphery of the expandable iris opening, wherein the boundary sleeve extends perpendicularly from the crotch portion.

In another aspect of the present invention, the male undergarment includes the following: a crotch portion dimensioned and adapted to be located adjacent to and cover a crotch region of the human wearer when the undergarment 100 is worn; an expandable iris opening adapted to be located adjacent to and cover a penis of the human wearer; a boundary sleeve defining a periphery of the expandable iris opening, wherein the boundary sleeve extends perpendicularly from the crotch portion, wherein an upper portion of the boundary sleeve extends from the crotch portion for up to one-half inch, and wherein a lower portion of the boundary sleeve extends from the crotch portion for up to quarter inch; and a veil attached along the crotch portion so as to be movable between a revealed condition and a concealed condition covering the expandable iris opening.

These and other features, aspects and advantages of the present invention will become better understood with reference to the following drawings, description and claims.

DETAILED DESCRIPTION OF THE INVENTION

Figure 1:
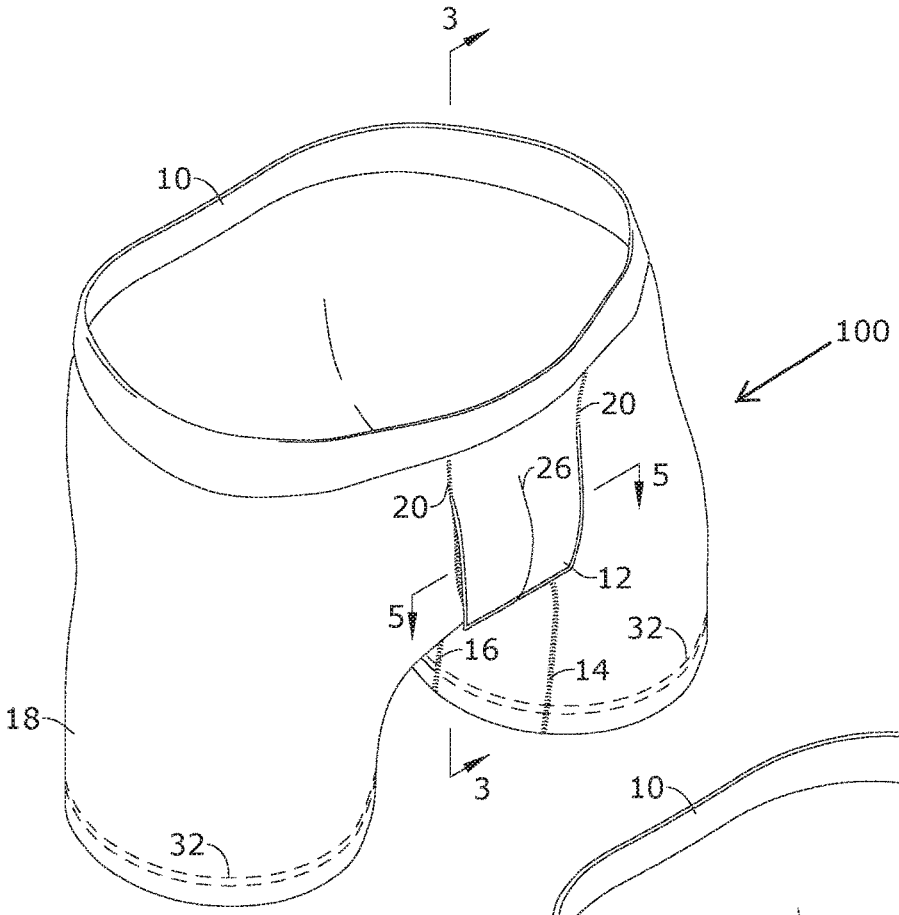
FIG. 1 is a perspective view of an exemplary embodiment of the present invention.
Figure 2:
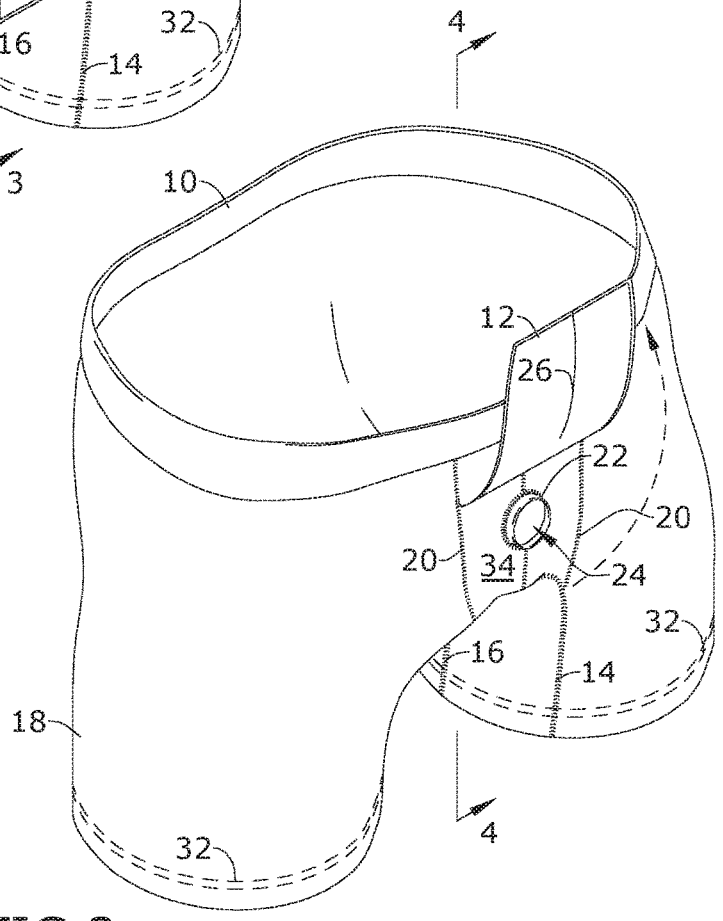
FIG. 2 is a perspective view of an exemplary embodiment of the present invention, with a veil in a revealed condition.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a male undergarment with an expanding iris opening for maintaining the penis of a male wearer in a natural position. The iris opening may be defined by a protruding boundary sleeve extending perpendicular from a crotch portion of the undergarment. The undergarment also provides a veil attached along the crotch portion, affording privacy and comfort by being movable between a concealed condition and a revealed condition.

Referring now to FIGS. 1 through 5, the present invention may include an undergarment 10 dimensioned and adapted to be worn around the waist of a human wearer. The undergarment 100 may be made from any suitable material 18 that along with a waistband 10, lower leg seams 32, front inner seam 14 and rear inner seam 16 so as to accommodate a human wearer's 30 upper portion of their lower body. The undergarment 100 may include a crotch portion 34 dimensioned and adapted to be located adjacent to and cover a crotch region of the human wearer 30 when the undergarment 100 is worn. The crotch portion 34 may be defined by a front seam 20. The crotch portion 34 may provide an iris opening 24 adapted to be located adjacent to a penis 28 of the human wearer 30 when the undergarment 100 is worn.

The iris opening 24 may be adapted to be expandable, enabling the iris opening 24 to be movable between a closed and open condition when accommodating the penis 28 in a natural condition. The periphery of the iris opening 24 may be made of materials such as nylon, spandex and other elastic material. In certain embodiments the material may be 95% nylon and 5% spandex sewn together to form the iris opening 24, and thereby providing its expandability. The iris opening 24 may be defined along an orthogonal x-y plane by the periphery, and further defined along a z-axis, orthogonal to the x-y plane, by a boundary sleeve 22, as illustrated in FIGS. 2 through 5. The x-y plane defining the planar (unworn condition) crotch portion 34. In use, the boundary sleeve 22 may perpendicularly extend from the crotch portion 34 away from the wearer 30 for approximately half to a full inch. The boundary sleeve 22 may also be made of elastic and/or pliable material, which maintains the penis in a natural yet comfortable position when the undergarment 100 is worn. In some embodiments, the iris opening 24 may be non-circular; in fact, the iris opening 24 may be any shape, so long as the iris opening 24 functions in accordance with the present invention as described herein A veil 12 may be attached along any edge or other part of the crotch portion 34 so that the veil 12 can be moved between a concealed position and a revealed position uncovering the iris opening 24 to enable access to the penis 28 in the revealed position and privacy in the concealed position. The veil 12 may be dimensioned in the concealed position to substantially cover the crotch portion 34 since the iris opening 24 may be urged to subsume the entire crotch portion 34 in the open condition because of the elasticity and expandability of its periphery. The veil 12 thus is dimensioned to cover the iris opening 24 in either the closed or open condition. The veil 12 veil may be approximately 7 inches long by approximately 4½ inches wide. The veil 12 may be made from a material that protects the penis from possible chafing. Combined, the two components of the iris opening 24 and the veil 12 provide a useful and comfortable position for a penis 28 to be placed while providing protection from any possible abrasion. The veil 12 may have a central seam 26.

Figure 3:
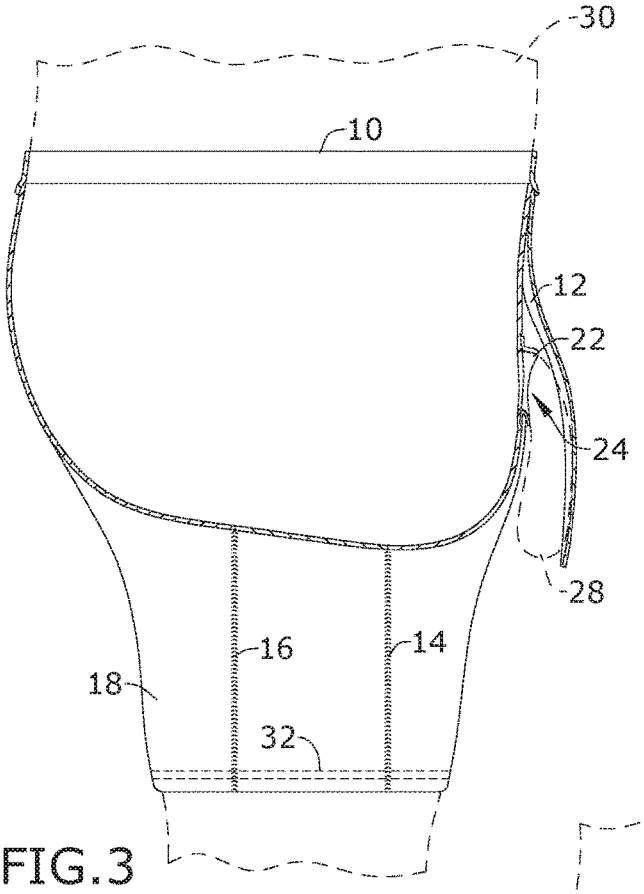
FIG. 3 is a section view of an exemplary embodiment of the present invention, taken along line 3-3 in FIG. 1.
Figure 4:
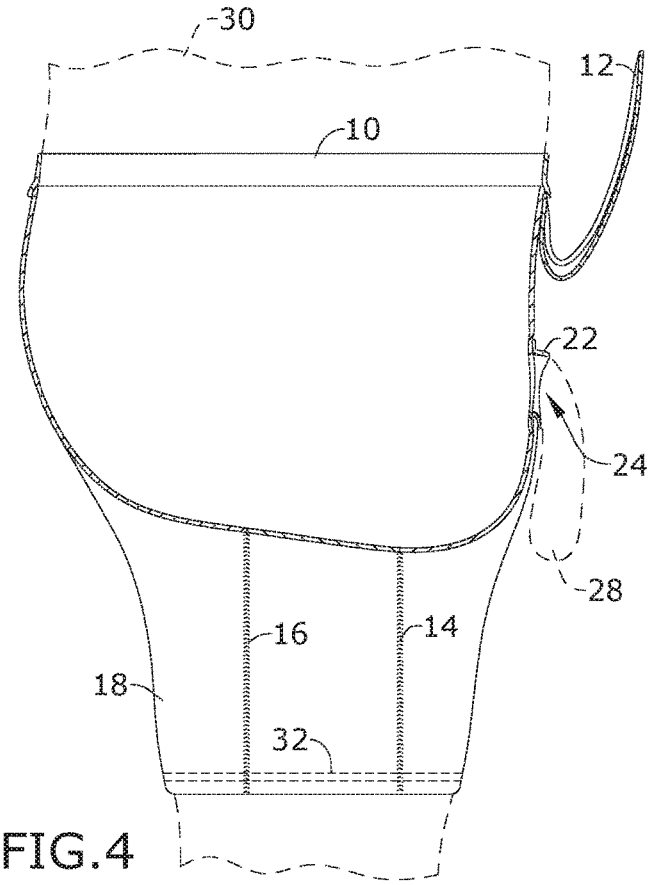
FIG. 4 is a section view of an exemplary embodiment of the present invention, taken along line 4-4 in FIG. 2.
Figure 5:
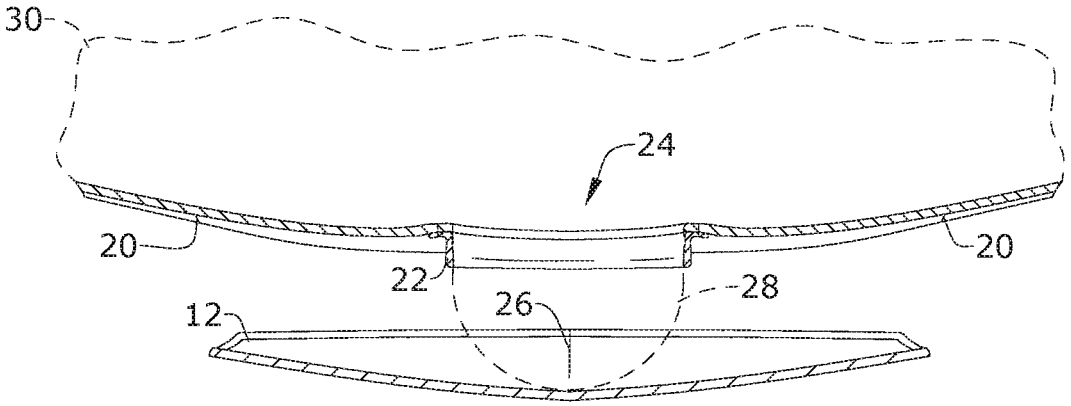
FIG. 5 is a section view of an exemplary embodiment of the present invention, taken along line 5-5 in FIG. 1.

A method of using the present invention may include the following. The undergarment 100 disclosed above may be worn by a human wearer 30. The expandable iris opening 24 allows the penis 28 to protrude therethrough and hang freely while the base of the penis 28 is supported on the boundary sleeve 22 while in a natural condition, as illustrated in FIGS. 3 through 5. The veil 12 allows the wearer 30 to quickly access the iris opening 24 and thus their penis 28 when needed, while affording privacy when not in use. The expandable iris opening 24 can work individually, before or after the veil 12 is stationed; however, it is recommended to use both components for purposes of each component's ability to provide corresponding benefits.

The iris opening periphery 24 and veil 12 may be attached to the undergarment 100 through convention joining methods for securing two objects together, such as stitching or the like.

Additionally, the present invention can be used for hospital patients needing a catheter or be used by patients who do not need all of their lower anatomy exposed.

It should be understood, of course, that the foregoing relates to exemplary embodiments of the invention and that modifications may be made without departing from the spirit and scope of the present invention.

What is claimed is:

1. A male undergarment, comprising:

a crotch portion dimensioned and adapted to be located adjacent to and cover a crotch region of a human wearer when the male undergarment is worn;

an expandable iris opening adapted to be located adjacent to and cover a base of a penis of the human wearer; and a boundary sleeve defining a periphery of the expandable iris opening, wherein the boundary sleeve extends perpendicularly from the planar crotch portion.

2. The male undergarment of claim 1, wherein the boundary sleeve extends from the crotch portion for up to one-half inch to one inch.

3. The male undergarment of claim 1, wherein an upper portion of the boundary sleeve extends from the crotch portion for up to one-half inch, and wherein a lower portion of the boundary sleeve extends from the crotch portion for up to one-half inch.

4. The male undergarment of claim 1, further comprising a veil attached along the crotch portion so as to be movable between a revealed condition and a concealed condition covering the expandable iris opening.

5. A male undergarment, comprising:

a crotch portion dimensioned and adapted to be located adjacent to and cover a crotch region of a human wearer when the male undergarment is worn;

an expandable iris opening adapted to be located adjacent to and cover a penis of the human wearer;

a boundary sleeve defining a periphery of the expandable iris opening, wherein the boundary sleeve extends perpendicularly from the crotch portion, wherein an upper portion of the boundary sleeve extends from the planar crotch portion for up to one-half inch to one inches, and wherein a lower portion of the boundary sleeve extends from the crotch portion for up to one-half inch; and a veil attached along the crotch portion so as to be movable between a revealed condition and a concealed condition covering the expandable iris opening.

* * * * *